United States Patent [19]

Vandame

[11] Patent Number: 4,732,437

[45] Date of Patent: Mar. 22, 1988

[54] ELECTRICAL CONNECTOR

[75] Inventor: Bertrand Vandame, Villepreux, France

[73] Assignee: Precision Mecanique Labinal, Bois d'Arcy, France

[21] Appl. No.: 882,471

[22] Filed: Jul. 7, 1986

[30] Foreign Application Priority Data

Jul. 4, 1985 [FR] France ..... 85 10220

[51] Int. Cl.[4] ..... H01R 13/40

[52] U.S. Cl. ..... 339/586; 439/592; 439/680; 439/871

[58] Field of Search ..... 339/59 R, 59 M, 61 R, 339/61 M, 258 R, 252 R, 252 S, 253 R, 256 R, 259 R, 186 R

[56] References Cited

U.S. PATENT DOCUMENTS

| | | | |
|---|---|---|---|
| 3,145,067 | 8/1964 | Mishelevich | 339/75 |
| 3,217,285 | 11/1965 | Barre | 339/49 |
| 3,299,396 | 1/1967 | Kinkaid | 339/258 R |
| 3,781,760 | 12/1973 | Mancini et al. | 339/59 R |

FOREIGN PATENT DOCUMENTS

| | | | |
|---|---|---|---|
| 0025306 | 3/1981 | European Pat. Off. | 339/186 M |
| 3313193 | 10/1984 | Fed. Rep. of Germany | 339/59 R |
| 2217827 | 9/1974 | France . | |
| 2269807 | 11/1975 | France . | |
| 2269216 | 11/1976 | France . | |
| 2344979 | 10/1977 | France . | |
| 2535910 | 11/1984 | France . | |

*Primary Examiner*—Gil Weidenfeld
*Assistant Examiner*—Paula A. Austin
*Attorney, Agent, or Firm*—Sandler & Greenblum

[57] ABSTRACT

An electrical connector including two complimentary box-shaped elements each including a body having a plurality of compartments. Each compartment includes an aperture to receive an electrical contact device, a locking device for engaging the electrical contact device to lock the contact device in the compartment, and a lug having a portion that is sufficiently steep to prevent the electrical contact device from passing over this portion of the lug when the electrical contact device is inserted into the compartment in a position different from a normal insertion position. Also provided is a barrier which consists of a ramp connected to the steep portion of the lug. In the normal insertion position the electrical contact device passes over the ramp and lug to be locked in the compartment, whereas in a position different from this normal insertion position the electrical contact device abuts the steep portion of the lug and cannot fully enter the compartment or engage the locking device.

36 Claims, 15 Drawing Figures

ELECTRICAL CONNECTOR

CROSS-REFERENCE TO RELATED APPLICATIONS

Reference is made to the following related copending applications of Applicant: U.S. Ser. No. 758,440 filed July 24, 1985; Ser. No. 816,626 filed Jan. 6, 1986; Ser. No. 701,180 filed Feb. 13, 1985; Ser. No. 865,018 filed May 20, 1986; and Ser. No. 880,888 filed on the filing date of the present application. Each of these applications are hereby incorporated by reference.

BACKGROUND OF THE INVENTION

1. Field of the Invention

The present invention relates to electrical connectors comprising two box-like elements adapted to be assembled to produce an electrical connection. Each box-type element comprises a plurality of compartments. Each compartment is adapted to receive an electrical contact device connected to an electrical conductor.

2. Description of Pertinent Information

In order to connect two electrical conductors, each electrical conductor is normally attached to an electrical contact device. One of the electrical contact devices can be a male contact device and the other of these contact devices can be a female contact device, so that these two contact devices are adapted to be inserted into one another to form a good electrical connection.

These male and female electrical contact devices must be protected so as to protect the electrical connection between the two electrical conductors. This protection is normally accomplished by attaching each electrical contact device to a housing or electrical connector.

One type of electrical connector that is currently in use comprises two box-type elements which are adapted to be assembled to produce the desired electrical connection. Each box-type element comprises a plurality of compartments, each of which is adapted to house and to hold an electrical contact device connected to an electrical conductor. Female electrical contact devices are inserted into the compartments of one box-type element, while male contact devices are inserted into the compartments of the other box-type element. When the two box-type elements are then assembled, the male and female contact devices are brought together to produce a good electrical connection.

Each electrical contact device comprises an element to which is adapted to engage a complementary element in the compartment of the connector so that the electrical contact device can be locked in the compartment. As a result, the electrical contact devices must be fitted into the compartments in a particular position. Otherwise, the electrical contact devices will either not rest firmly in the housing of the box-like element, the electrical contact devices will not produce a satisfactory electrical connection, or the electrical contact devices will interfere with the assembly of the box-type elements.

Thus, there is a need for an electrical connector which will prevent any electrical connection at all if the electrical contact devices are not positioned properly in the connector, and there is also a need for a connector which will prevent the electrical contact devices from being inserted into the connectors when the are improperly positioned so that the electrical connectors cannot interfers with the assembly of the box-type elements of the connector.

SUMMARY OF THE INVENTION

It is an object of the present invention to provide a connector which overcomes the disadvantages of the prior art.

It is a further object of the present invention to provide an electrical connector which permits the locking of the electrical contact devices in the electrical connector only if the electrical contact devices are positioned in a proper position.

It is another object of the present invention to prevent the electrical contact devices from interfering with the assembly of the box-type elements when the electrical contact devices are improperly positioned in the connector.

The invention which achieves these objectives relates to an electrical connector comprising at least one compartment adapted to house an electrical contact device. Each compartment has an aperture therein adapted to permit the electrical contact device to extend therethrough. At least one compartment comprises a locking device for locking the electrical contact device in the at least one compartment in response to inserting the electrical contact device in the at least one compartment through the aperture and positioning the electrical contact device and the at least one compartment in a first position with respect to each other. The compartment also comprises means for preventing the locking device from locking the electrical contact device in the at least one compartment in response to positioning the electrical contact device and the at least one compartment in a position other than the first position with respect to each other.

In addition, the connector can comprise a plurality of compartments, and the connector can comprise two complementary box-shaped elements, each element comprising a body comprising the plurality of compartments.

In one embodiment the locking prevention means comprises means for preventing the locking device from locking the electrical contact device in the at least one compartment when the at least one compartment and the electrical contact device are rotated relative to one another along the longitudinal axis along the connector. Further, the at least one compartment can comprise means for attaching the electrical contact device to another electrical device housed in a substantially identical connector when the electrical contact device and the another electrical contact device are locked in their at least one compartments in the first position, and the at least one compartments of the connector and the substantially identical connector are attached to one another. In addition, the present invention relates to such a connector in combination with the substantially identical connector.

The electrical contact device comprises a portion complementary to the locking device. The locking device as a result, comprises means for engaging this complementary portion when the electrical contact devices in its first position. In addition, the preventing means comprises a barrier for preventing the locking device from engaging the complementary portion of the electrical contact means. This barrier can comprise a ramp.

The locking devices can also comprise a lug comprising a wall at least as tall as the ramp. In this embodiment the ramp abuts the wall, and the ramp comprises means for guiding the electrical contact device over the ramp and the lug in response to relative displacement of the electrical contact device and the connector along the longitudinal axis of the at least one compartment when the electrical contact device in its first position. The ramp further comprises means for guiding that portion of the electrical contact device in front of the complementary portion to abut the wall of the lug in response to relative displacement of electrical contact device and the connector along the longitudinal axis of the connector when the electrical contact device is in a position other than its first position.

The complementary portion of the electrical contact device can comprise the first surface of the electrical contact device having an opening therein. The lug of the connector is adapted to engage this opening. In addition, the electrical contact device further comprises a second surface comprising a front end. The second surface is positioned above the first surface. Also, the front end of the second surface has an aperture. The ramp has a smaller width than the aperture of the electrical contact, and the wall of the lug has a larger width than the aperture of the electrical contact device. The present invention also relates to this connector defined above in combination with the electrical contact device.

The lug can have an inverted frusto-pyramidal shape having rectangular bases. In addition, the connector further comprises an elastic strap adapted to support the lug. The first surface of the electrical contact device comprises a floor of the electrical contact device and the elastic strap is inclined to provide a space between the elastic strap and the floor to permit insertion of a tool for disengaging a lug and the aperture in the first surface.

The lug can be larger than the aperture in the first surface of the electrical contact device.

In another embodiment, the locking device comprises an elastic tongue comprising a heel for engaging a stop of the electrical contact device. In this embodiment the locking device comprises the heel of the elastic tongue. In addition, at least one compartment has a longitudinal axis, and at least one compartment is adapted to receive the electrical device when the electrical contact device is inserted into the aperture of the at least one compartment and displaced substantially along the longitudinal axis. Also, the heel comprises means for preventing displacement of the electrical contact device along the longitudinal direction out of the at least one compartment in response to engagement of the heel and the stop.

The heel comprises a surface facing the aperture of the at least one compartment. This surface comprises at least one ramp for guiding the electrical contact device over the ramp so that the stop engages the heel after the electrical contact devices engages the ramp relative displacement of the electrical contact element and the connector along the longitudinal axis of the compartment.

The elastic tongue further comprises a lug comprising a surface extending substantially vertically and spaced a predetermined distance from one end of the compartments. The surface comprises means for abutting the electrical contact device preventing relative displacement of the connector and the electrical contact along the longitudinal axis of the compartment so as to prevent positioning of the electrical contact device in the space between one end of the compartment and the surface in response to positioning of the electrical contact device in a position other than the first position.

One end of the compartment comprises another aperture for receiving another electrical contact device. In this embodiment, the at least one compartment further comprises a shoulder adjacent the another aperture for engaging a free edge of a tab of the electrical contact device.

The at least one ramp comprises means for guiding the tab, positioned in front of the stop on the electrical contact device, over the ramp and the heel so that the heel engages the stop when the electrical contact device is in its first position. The invention also relates to the connector defined above in combination with the electrical contact.

The elastic tongue further comprises first and second adjacent inclined ramps. The second incline ramp abuts the surface of the lug. The ramp of the heel is spaced from the surface of the lug in a direction transverse to the longitudinal axis of the compartment. In this embodiment the compartment comprises first and second lateral walls. The heel also comprises first and second spaced apart ramps. The first ramp of the heel is spaced closer to the first lateral wall than the second ramp of the heel. Also, the second ramp of the heel is spaced closer to the second lateral wall than the first ramp of the heel. The first ramp of the heel is spaced closer to the first lateral wall than the surface of the lug, and the second ramp of the heel is spaced closer to the second lateral wall than the surface of the lug.

The electrical contact device further comprises two spaced apart tabs. Each of the ramps are adapted to engage one of these tabs. Also, the width of the heel is substantially the same as the distance between the tabs, and the width of the heel is greater than the width of the lug and the first and second inclined ramps.

The invention also relates to connector defined in the above paragraphs in combination with the electrical contact device. In this embodiment the electrical contact device further comprises two spaced apart lateral walls each having one end. The ends of the spaced apart lateral walls of the electrical contact device each comprises one tab adapted to engage one of the ramps of the heel. Also, each lateral wall of the electrical contact device further comprises a notch behind the tab. The length of the lug is greater than width of the notches.

The invention also relates to an electrical connector comprising at least one compartment adapted to house first electrical contact device. The at least one compartment has an aperture therein adapted to permit the electrical contact device to extend therethrough. The electrical contact device and the at least one compartment are adapted to positioned in a first position with respect to each other. The at least one compartment comprises a first portion extending from the aperture inwardly, and a second portion extending from the first portion away from the aperture. The second portion is adapted to be connected to a second electrical contact device, and the first and second portions comprises means for receiving the first electrical contact device. The at least one compartment also comprises means for preventing the electrical device from extending into the second portion from the first portion in response to positioning the electrical contact device and the at least one compartment in a position other than the first position with respect to each other.

The prevention means comprises means for permitting the electrical contact device to extend into the second portion in response to positioning the electrical contact device and at least one compartment in the first position. The prevention means also comprises a lug and a ramp abutting the lug. The lug comprises means for engaging an opening in the electrical contact device positioned behind the front of the electrical contact device when the electrical contact device and the at least one compartment are in the first position so as to lock the electrical contact device into engagement with the connector. The ramp further comprises means for guiding the electrical contact device over the ramp and over the lug so that the lug engages the opening. The ramp further comprises means for engaging an aperture in the front of the electrical contact device and for guiding the front of the electrical contact device to abut the lug so as to space the opening from the lug, thereby preventing engagement of the opening and the lug when the electrical contact device and the at least one compartment are positioned in a position other than the first position. The invention also relates to the above electrical connector in combination with the electrical contact device.

The electrical contact device can comprise a stop behind the front of the electrical contact device. The prevention means comprises an elastic tongue comprising a lug comprising means for engaging the front of the electrical contact device when the electical contact device and the at least one compartment are in a position other than the first position. Also, the elastic tongue comprises a heel having a surface facing the aperture of the connector. The surface comprises two spaced apart ramps. Each of the ramps comprises means for engaging one of the two spaced apart tabs on the electrical contact device during insertion of the electrical contact device into the first portion so as to permit the tabs to pass over the ramps into the second portion, thereby permitting the positioning of the heal at substantially the same position along the longitudinal axis of the compartment as the stop so that the heel comprises means for engaging the stop when the electrical contact device and the at least one compartment are in the first position with respect to each other.

The invention also relates a hermaphroditic electrical contact device comprising a rear end comprising means for enclosing an electrical conductor, a floor having an opening therein, first and second lateral walls, a top wall connecting the first and second lateral walls and substantially parallel to the floor, so that the top wall comprises a free front end having a substantially U-shaped aperture therein, and an extension extending from the floor in front of the top wall.

The invention also relates to an electrical contact device comprising a rear end comprising means for enclosing an electrical conductor, and a front end comprising a channel comprising an upper edge and a substantially U-shaped extension comprising two spaced apart tabs having rounded ends. The tabs extend higher than the upper edge of the channel, and the device further comprises a notch positioned between the tabs and the channel. The notch is positioned lower than the upper edge of the channel.

The invention also relates to an electrical connector comprising two complementary shaped box elements, each comprising a body comprising a plurality of compartments. Each compartment comprising an aperture adapted to receive an electrical contact device, a locking device for engaging a complementary device on the electrical contact device to lock the electrical contact device in the compartment, and a portion extending from the aperture. This portion comprises a lug and a barrier. The lug comprises a portion sufficiently steep to prevent the electrical contact device from passing over the portion of the lug when the electrical contact devices is inserted into the compartment in a position different from a normal insertion position. The barrier comprises a ramp connected to the steep portion of the lug. In the normal insertion position the electrical contact device passes over the ramp and the lug. In a position different from this normal insertion position the electrical contact device abuts the steep portion of the lug.

The locking device comprises in one embodiment the lug. In this embodiment the complementary device comprises an opening in a first surface of the electrical contact device. Also, in this embodiment the barrier has a width smaller than an aperture positioned at the free end of a second wall of the electrical contact device positioned above the first wall. Also, the width of the lug is larger than the width of the aperture of the electrical contact device. In one embodiment the invention relates to such a connector in combination with the electrical contact device. Also, the lugs can have the shape of an upside-down frusto-pyramid.

The locking device can comprise in another embodiment an elastic tongue comprising a heel comprising means for engaging a stop on the electrical contact device. The heel comprises a surface facing the aperture. The surface comprises a plurality of ramps comprising means for engaging tabs positioned on the free end of the electrical contact device. The tongue also comprises the lug discussed above. The heel is integral with the lug, and the lug disengages from the electrical contact device when the electrical contact device is inserted into the compartment in its normal insertion position. Also, the steep portion of the lug prevents the electrical contact device from being inserted into the compartment when the electrical contact device is inserted into a position different from the normal insertion position.

BRIEF DESCRIPTION OF THE DRAWINGS

The invention will now be understood it will now be described in greater detail by reference to several specific embodiments which serve to explain the invention solely by example only, in conjunction with the attached drawings in which.

DETAILED DESCRIPTION OF PREFERRED EMBODIMENTS

Figure 1:
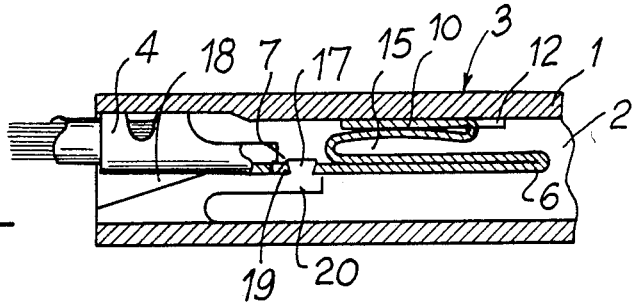
FIG. 1 is an axial cross-sectional view of the electrical connection element of the present invention.

One of the objects of the present invention is to provide an electrical connector which prevents electrical contact devices from engaging corresponding compartments in a complementary electrical connector when the electrical contact devices have not been positioned correctly in the electrical connector in which they are housed.

The invention which achieves this objective relates to electrical connectors comprising two complementary box-type elements, each comprising a body comprising a plurality of compartments. Each compartment has an aperture therein for receiving an electrical contact device therethrough. Further, each compartment comprises a locking device adapted to engage a complementary device on the electrical contact device to lock the electrical contact device in the compartment. Each compartment in the box-type element comprises, on a side of the compartment correspondingly to the aperture, a barrier comprising a ramp, and a lug connected to the ramp by a steep portion. The electrical contact device is adapted to ensure that in a normal insertion position in which it engages the compartment, the electrical contact device can clear the lug, whereas if the electrical contact device is inserted into the compartment in a different position it will come to rest and abut the steep portion of the lug.

The locking device of each compartment can comprise the lug itself, while the complementary device on the electrical device can comprise an opening in one of the surfaces of the electrical contacting device. The electrical contact device also comprises a wall positioned above this surface. The opening in the lower surface is adapted to engage the lug. In addition, the wall above the lower surface comprises at its free end an aperture having a larger size then the width of the barrier but smaller than the width of the lug.

This arrangement ensures than when the contact device has engaged the appropriate compartment in a normal insertion position and direction, the ramp will facilitate the guiding of the electrical contact device over the lug, whereas when the electrical contact device engages the ramp in a different position, for instance upside-down, the free ends adjacent to the aperture will come to rest against the lug so that the ramp is lodged in the aperture, thereby making it impossible to insert the electrical contact device into the compartment. As a result, the device of the present invention insures a high degree of safety in the assembly of electrical connectors.

The lug preferable has the shape of an inverted frusto-pyramid, which enables the electrical connection device to be firmly logged in the compartment of the box-type element.

The present invention is particularly well adapted to electrical contact elements of the so-called hermaphroditic type which comprise either a male or female device and which can form complementary devices in pairs, one member of the pair being "head-to-tail" and upside down with respect to the other.

In one embodiment, the looking device of the compartment of the box-element comprises an elastic tongue comprising a heel adapted to engage a stop of the electrical contact device. The free end of the electrical contact device comprises two tabs adapted to engage ramps provided on the surface of the heel which faces the insertion aperture. The heel is integral with the lug so that the lug can be disengaged from the electrical contact device when the contact device engages the compartment in a normal position, whereas the steep portion of the lug will prevent the electrical contact device from being inserted into the compartment at all if it has not been inserted into the compartment in the correct position.

FIG. 1 illustrates an electrical connector element comprising a part 1 of a box. Part 1 is adapted to engage a complimentary part, not shown. Part 1 comprises a plurality of compartments 2, each of which are adapted to receive an electrical contact device 3.

Figure 2:
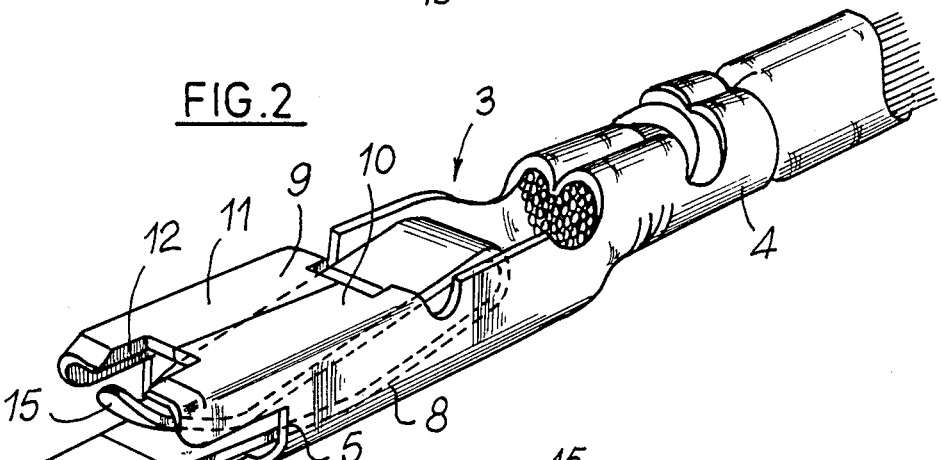
FIG. 2 is a perspective view of an electrical contact device of the present invention.

FIG. 2 illustrates electrical contact device 3. Device 3 is hermaphroditic, i.e., device 3 is adapted to engage in a substantially identical contact by engaging a complimentary portion of this contact and by positioning this other substantially identical contact "head-to-tail" and upside down with respect to the other contact. In addition, the present invention can also be applied to other devices, whether they are male or female electrical connection devices.

Electrical contact device 3 is composed of an elastic strip of metal of good electrical conductivity and suitably out and bent to present at one end a means for enclosing an electrical conductor.

Electrical contact device 3 is bent to form a channel 5 of substantially rectangular cross-section which is formed by a floor 6 having a hole 7 therein, two side or lateral walls 8 and 9, and two top surfaces 10 and 11 which are attached to one of the lateral walls, and which are substantially parallel to floor 6. Top surfaces 10 and 11 are notched at their free end in such a way as to form a substantially U-shaped aperture 12.

Floor 6 of channel 5 comprises a prolongation or extension 13 which is bent towards the inside of the channel. The bend in extension 13 is a hair pin bend. Extension 13 terminates in an elastic tongue 15.

When two connection devices 3 are placed one opposite the other, and with one of the upside down with respect to the other, extension 13 and floor 6 of each of them engage the space between extension 13 and elastic tongue 15 of the other.

Figure 3:
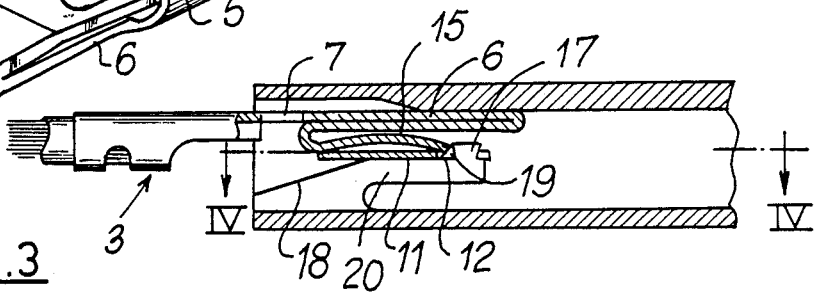
FIG. 3 is a schematic sectional view of the box element of the electrical connector of the present invention in which the electrical contact device is not engaged in the correct manner in the box-type element.

As is illustrated in FIGS. 1 and 3, compartment 2 of part 1 comprises an elastic strap 20 having a lug 17 adapted to engage a hole 7 in floor 6 of the channel. In order to facilitate the installation of device 3 an inclined ramp 18 is provided which extends as far as a point in the vicinity of the corresponding edge of one of the ends of part 1.

Lug 17 is larger than aperture 12 and has a length that is greater than the length of aperture 12, and is connected to a barrier 19 forming a ramp, as seen in FIGS. 5–8. This lug has the shape of an inverted frusto-pyramid with rectangular bases, and has an inclined steep portion on the side of the lug corresponding to that portion of the channel in which contact 3 is inserted.

When device 3 is inserted into compartment 2 as is illustrated in FIGS. 1, 5, 6, and 7 extension 13 is guided by the ramp formed by barrier 19, so that extension 13 passes over barrier 19 and the top of lug 17, thereby elastically deforming strap 20 so that lug 17 penetrates opening 7 and locks device 3 into part 1.

Figure 4:
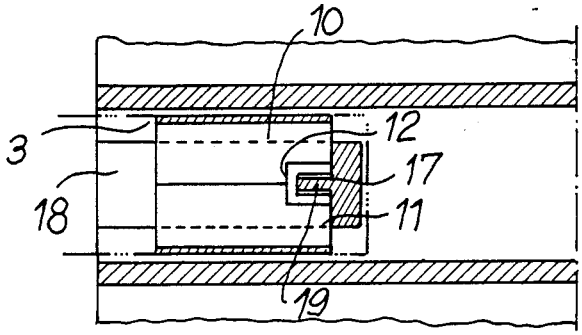
FIG. 4 is a cross-sectional view taken long line IV—IV FIG. 3.
Figure 5:
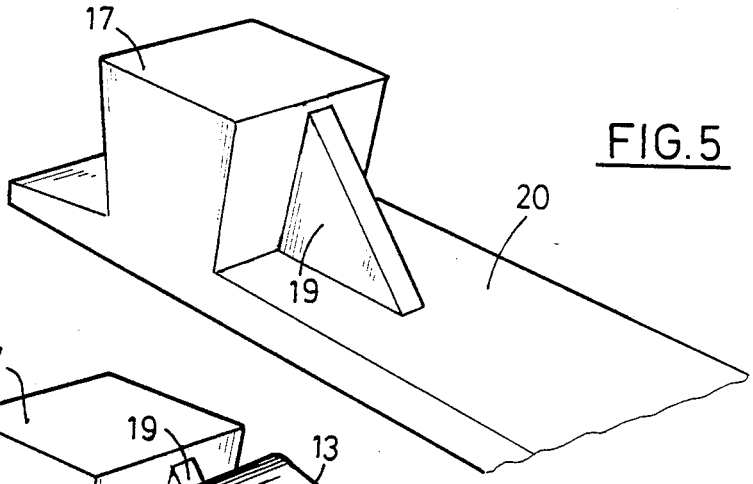
FIGS. 5–7 are enlarged schematic views showing the insertion of the electrical connection device in a correct assembly position.
Figure 6:
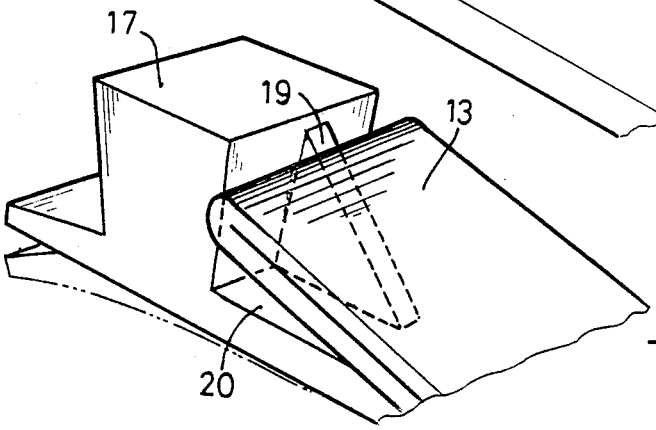
Figure 7:
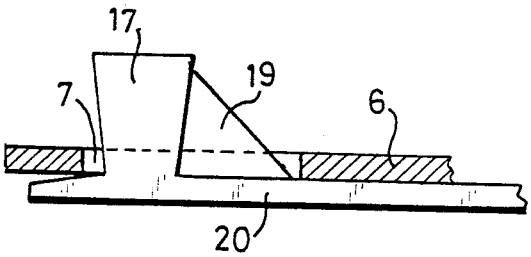
Figure 8:
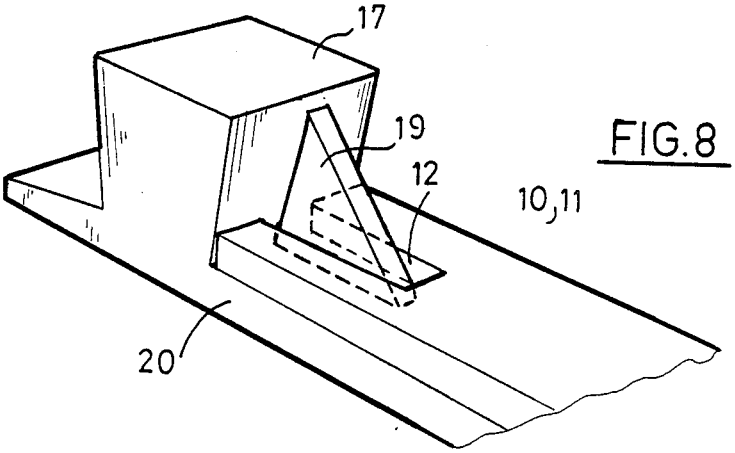
FIG. 8 is an enlarged schematic perspective view showing the insertion of the electrical contact device into the electrical connector in an incorrect position.

If, on the other hand, device 3 is not positioned in a correct insertion position, which is illustrated in FIGS. 3, 4, and 8, the free end of top surfaces 10 and 11 of the channel of device 3 will come to rest against the steep wall of lug 17 while ramp 19 will become lodged in aperture 12. This prevents any engagement or locking of device 3 in housing 2 and prevents any engagement of lug 17 in opening 7.

It should be noted that the free end of strap 20 is inclined in order to provide a space between floor 6 of device 3 and strap 20 so that the end of a tool such as a screwdriver can be inserted between floor 6 and strap 20 so that connection device can be removed from housing 2 by disengaging lug 17 from opening 7.

Figures 9, 10, 11:
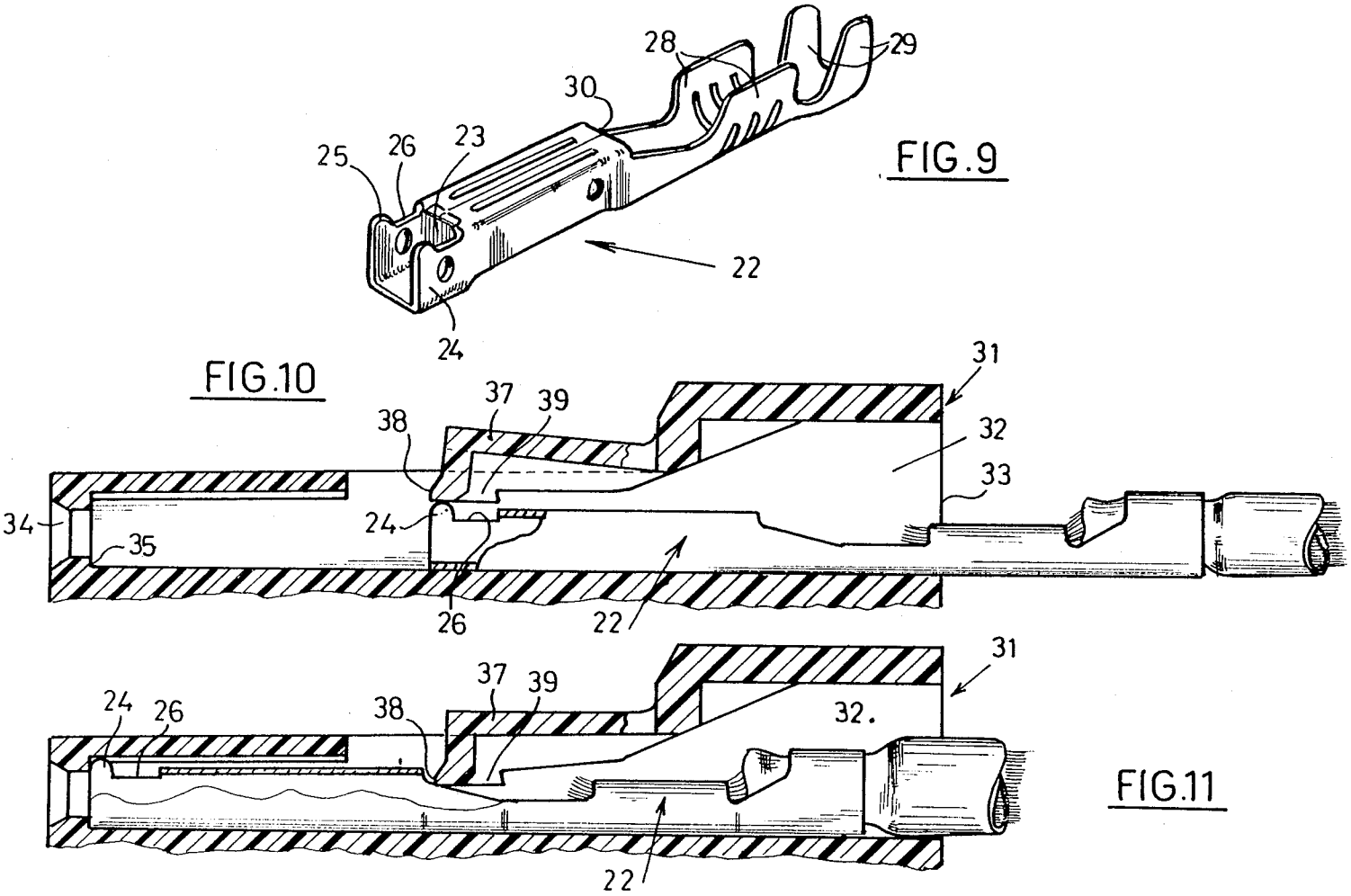
FIG. 9 illustrates a perspective view of another embodiment of the electrical contact device of the present invention.
FIG. 10 illustrates a cross-sectional axial view of the device illustrated in FIG. 9 when this electrical contact device engages a compartment of the box-type electrical connector.
FIG. 11 illustrates an axial cross-sectional view of the electrical contact device illustrated in FIG. 9 and the electrical connector similar to FIG. 10, except that the electrical contact device is inserted completely in the compartment of the box-type connector.

FIG. 9 shows another embodiment of an electrical contact device. This device comprises an electrical contact device 22 which is bent at one end in order to form a channel 23 of substantially rectangular cross-section. One end of the channel is extended by a U-shaped portion 24 comprising two tabs 25. The ends of tabs 25 are rounded and slightly higher than the upper edge of channel 23. Also provided on device 22 is a shallow notch 26 positioned between each tab 24 and the corresponding edge of channel 23.

Device 22 is fitted, at the end opposite to that provided with tabs 24, with clamps 28 and 29 which serve to grip the sheath of the wires comprising the electrical conductor.

Device 22 is adapted to engage a corresponding male device comprising a bar of a rectangular cross-section.

The end of channel 23 adjacent clamps 28 and 29 comprises a stop 30 adapted to engage the locking device in box element 31.

The box-type connector illustrated in FIGS. 10–13 comprises a body 31 having a plurality of compartments 32, each of which are adapted to house and receive device 22.

Each compartment 32 comprises, at one of its ends, an aperture 33 adapted to receive device 22. The opposite end of compartment 32 comprises an aperture 34 adapted to receive a male electrical contact device. Also provided at this end is a shoulder 35 which is adjacent aperture 34 and which is adapted to engage the free edge of tabs 24 when device 22 is inserted completely in compartment 32 in a normal insertion or assembly position.

Figure 14:
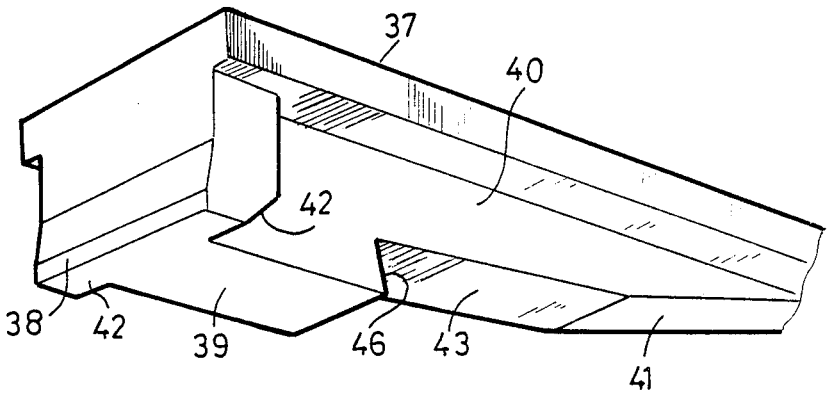
FIGS. 14 and 15 show enlarged perspective views of an elastic tongue of the compartments in the connector of the present invention.
Figure 15:
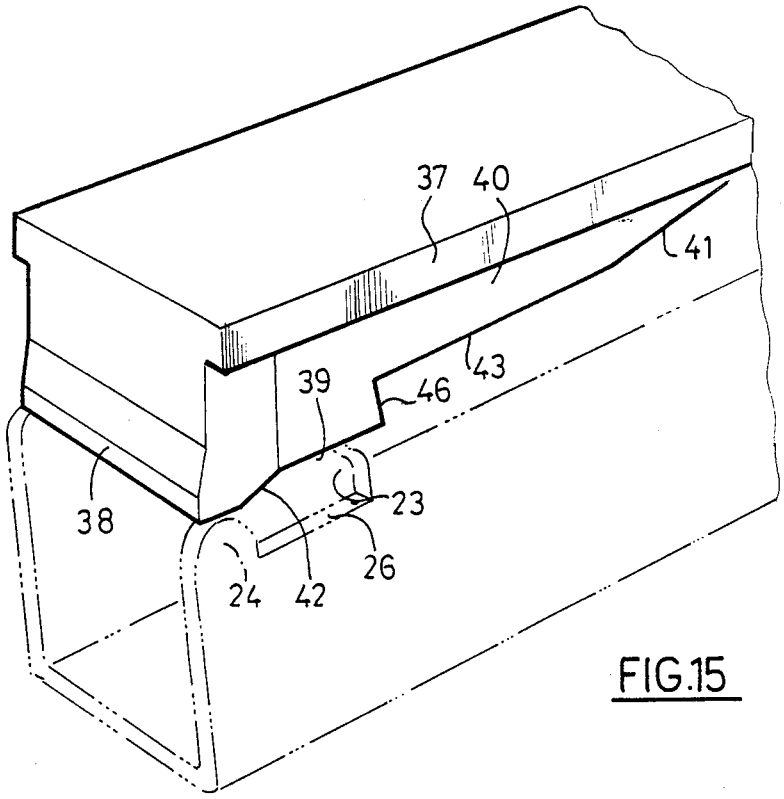

Each compartment comprises an elastic locking tongue 37 illustrated in FIGS. 14 and 15, which comprises a heel 38 adapted to engage stop 30 in order to lock device 22 in the compartment when it has been placed in its normal insertion position completely in compartment 32 along an insertion axis.

Elastic locking tongue 37 comprises a barrier 40 having two adjacent inclined ramps 41 and 43, and a lug 39 adjacent ramp 43. Heel 38 extends further to each side, that is in the transverse direction to the longitudinal direction of the compartment, than lug 39. Further, heel 38 is provided facing aperture 33, with two ramps 42 on either lateral side of heel 38.

The width of heel 38 is substantially equal to the distance between tabs 24, while ramps 41 and 43 and lug 39 are narrower than heel 38. Also, lug 39 is connected to ramp 43 by a steep portion 46 of lug 39.

The length of lug 39 which is positioned between heel 38 and its free end is slightly greater than the width of notches 26.

As is illustrated in FIGS. 10 and 11, when device 22 is inserted into compartment 32 along an insertion axis in a normal assembly position the free end of the upper edge of channel 23 of device 22 comes to rest against ramps 41 and 43, thus slightly raising tongue 37. Continued displacement of device 22 in the longitudinal direction into the compartment causes tabs 24 to bear against ramps 42, thus disengaging the tongue from device 22. Next, lug 39 bears against the upper part of channel 23 until heel 38 coincides in position with stop 30. In this position, illustrated in FIG. 11, device 22 is gripped between shoulder 35 and heel 38, so that it is locked in the compartment. The position illustrated in FIG. 10 is the normal insertion position which permits device 22 to be locked in the compartment.

Figure 12:
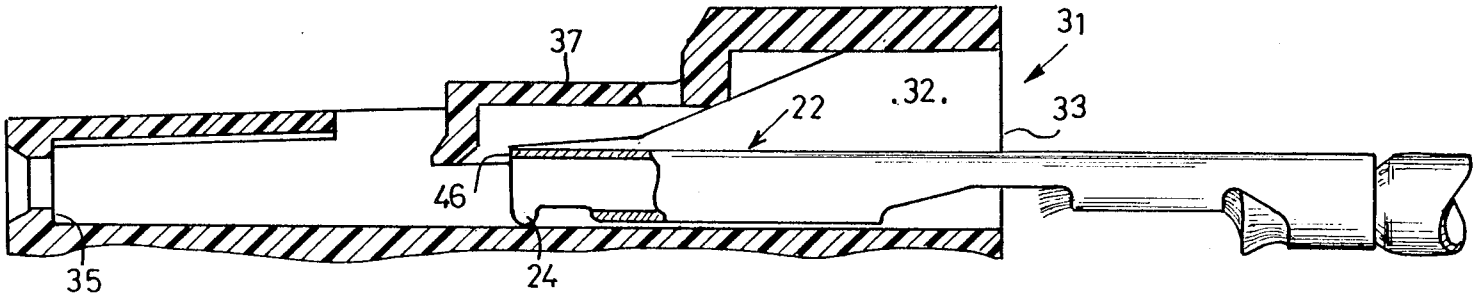
FIGS. 12 and 13 illustrates axial cross-sectional views of the electrical contact device of FIG. 9 being inserted in two incorrect positions into the electrical connectors.
Figure 13:
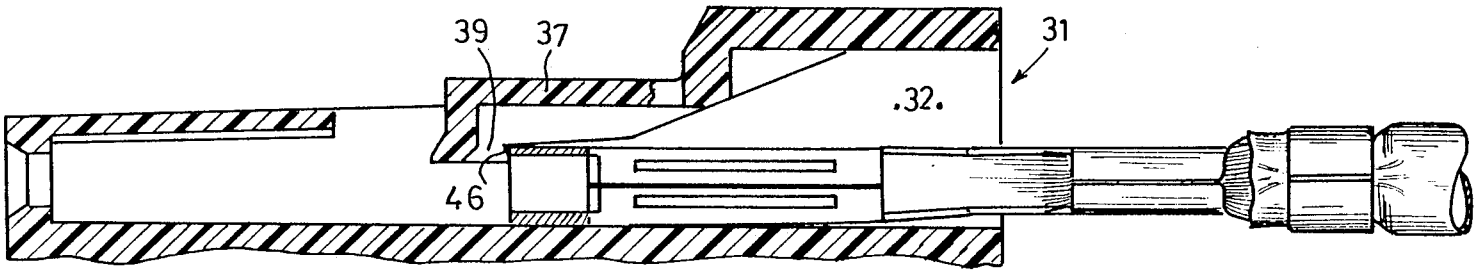

If device 22, on the other hand is introduced into compartment 32 "inside out" as is illustrated in FIG. 12, the floor of device 22 will come to rest against steep portion 46 of lug 39 in such a way that device 22 can not be placed into the locked position, which is illustrated in FIG. 12. As a result, the front end of device 22 will not pass beyond lug 39 into the rest of the compartment. In addition, if device 22 is rotated 90° with respect to the position illustrated in FIG. 10, the device 22 also can not be positioned into the compartment further than lug 39. This position is illustrated in FIG. 13.

It should be understood that although the invention has been described with respect to particular means, methods and embodiments, that the invention is not limited thereto, but extends to all equivalents within the scope of the claims.

What is claimed is:

1. An electrical connector having at least one compartment adapted to house an electrical contact device wherein said at least one compartment has an aperture therein adapted to permit said electrical contact device to extend therethrough, said at least one compartment comprising:

(a) a locking device including a lug having a wall for locking said electrical contact device having a portion complementary to said locking device in said at least one compartment in response to inserting said electrical contact device in said at least one compartment through said aperture and positioning said electrical contact device and said at least one compartment in a first position with respect to each other, said locking device including means for engaging said portion complementary to said locking device when said electrical contact device is in said first position;

(b) means for preventing said locking device from locking said electrical contact device in said at least one compartment when said at least one compartment and said electrical contact device are rotated relative to each other along the longitudinal axis of said connector, said means for preventing comprising a ramp for preventing said locking device from engaging said portion complementary to said locking device said wall of said lug being at least as tall as said ramp and being adapted to abut said ramp, said ramp including:

(i) means for guiding said electrical contact device over said ramp and said lug in response to to relative displacement of said electrical contact device and said connector along the longitudinal axis of said at least one compartment when said electrical contact device is in said first position, and (ii) means for guiding that portion of said electrical contact device in front of said complementary portion to abut said wall of said lug in response to relative displacement of said electrical contact device and said connector along the longitudinal axis of said connector when said electrical contact device is in said position other than said first position.

2. The connector defined by claim 1 wherein said connector comprises a plurality of said compartments.

3. The connector defined by claim 2 wherein said connector comprises two complementary box-shaped elements, each element comprising a body comprising said plurality of said compartments.

4. The connector defined by claim 1 wherein said at least one compartment comprises means for attaching said electrical contact device to another electrical contact device housed in a substantially identical connector when said electrical contact device and said another electrical contact device are locked in their at least one compartments in said first position and said at least one compartments of said connector and said substantially identical connector are attached to each other.

5. The connector defined by claim 4 in combination with said substantially identical connector.

6. The connector defined by claim 1 wherein said complementary portion of said electrical contact device comprises a first surface of said electrical contact device having an opening therein, wherein said lug is adapted to engage said opening.

7. The connector defined by claim 6 wherein said electrical contact device further comprises a second surface comprising a front end, wherein said second surface is positioned above said first surface, wherein said front end of said second surface has an aperture therein, wherein said ramp has a smaller width than said aperture of said electrical contact device, wherein said wall of said lug has a larger width than said aperture of said electrical contact device.

8. The connector defined by claim 7 in combination with said electrical contact device.

9. The connector defined by claim 8 wherein said lug has an inverted frusto-pyramidal shape having rectangular bases.

10. The connector defined by claim 9 wherein said lug is larger than said aperture in said first surface of said electrical contact device.

11. The connector defined by claim 9 wherein said connector further comprises an elastic strap attached to and supporting said lug.

12. The connector defined by claim 11 wherein said first surface comprises a floor of said electrical contact device, wherein said elastic strap is inclined to provide a space between said elastic strap and said floor to permit insertion of a tool for disengaging said lug and said aperture in said first surface.

13. The connector defined by claim 1 wherein said locking device comprises an elastic tongue comprising a heel for engaging a stop on said electrical contact device.

14. The connector defined by claim 13 wherein said at least one compartment has a longitudinal axis, wherein said at least one compartment is adapted to receive said electrical contact device when said electrical contact device is inserted into said aperture of said at least one compartment and displaced substantially along said longitudinal axis, wherein said heel comprises means for preventing displacement of said electrical contact device along said longitudinal direction in a direction out of said at least one compartment in response to engagement of said heel and said stop.

15. The connector defined by claim 14 wherein said heel comprises a surface facing said aperture of said at least one compartment, wherein said surface comprises at least one ramp for guiding said electrical contact device over said ramp so that said stop engages said heel after said electrical contact device engages said ramp during relative displacement of said electrical contact element and said connector along the longitudinal axis of said compartment.

16. The connector defined by claim 15 wherein said elastic tongue further comprises a lug comprising a surface extending substantially vertically and being spaced a predetermined distance from one end of said compartment, wherein said surface comprises means for abutting said electrical contact device and preventing relative displacement of said connector and said electrical contact device along the longitudinal axis of said compartment so as to prevent positioning of said electrical contact device in said space between said one end of said compartment and said surface in response to positioning of said electrical contact device in a position other than said first position.

17. The connector defined by claim 16 wherein said one end of said compartment comprises another aperture for receiving another electrical contact device.

18. The connector defined by claim 17 wherein said at least one compartment further comprises a shoulder adjacent said another aperture for engaging a free edge of a tab of said electrical contact device.

19. The connector defined by claim 16 wherein said at least one ramp comprises means for guiding a tab positioned in front of said stop on said electrical contact device over said ramp and said heel so that said heel engages said stop when said electrical contact device is in said first position.

20. The connector defined by claim 19 in combination with said electrical contact device.

21. The connector defined by claim 16 wherein said elastic tongue further comprises first and second adjacent inclined ramps, wherein said second inclined ramp abuts said surface of said lug.

22. The connector defined by claim 21 wherein said ramp of said heel is spaced from said surface of said lug in a direction transverse to the longitudinal axis of said compartment.

23. The connector defined by claim 22 wherein said compartment comprises first and second lateral walls, wherein said heel comprises first and second spaced apart ramps, wherein said first ramp of said heel is spaced closer to said first lateral wall than said second ramp of said heel, wherein said second ramp of said heel is spaced closer to said second lateral wall than said first ramp of said heel, wherein said first ramp of said heel is spaced closer to said first lateral wall than said surface of said lug, wherein said second ramp of said heel is spaced closer to said second lateral wall than said surface of said lug.

24. The connector defined by claim 22 wherein said electrical contact device comprises two spaced apart tabs, wherein each of said ramps are adapted to engage one of said tabs.

25. The connector defined by claim 24 wherein the width of said heel is greater than the width of said lug and said first and second inclined ramps.

26. The connector defined by claim 24 wherein the width of said heel is substantially the same as the distance between said tabs.

27. The connector defined by claim 26 in combination with said electrical contact device, wherein said electrical contact device further comprises two spaced apart lateral walls each haviang one end, wherein said ends of said spaced apart lateral walls of said electrical contact device each comprise one tab adapted to engage said one of said ramp of said heel, wherein each lateral wall of said electrical contact device further comprises a notch behind said tab, wherein the length of said lug is greater than the width of said notches.

28. An electrical connector comprising at least one compartment adapted to house a first electrical contact device wherein said at least one compartment has an aperture therein adapted to permit said first electrical contact device to extend therethrough, wherein said first electrical contact device and said at least one compartment are adapted to be positioned in a first position with respect to each other, wherein at least one compartment comprises:

a first portion extending from said aperture inwardly;

a second portion extending from said first portion away from said aperture, wherein said second portion is adapted to be connected to a second electrical contact device, wherein said first and said second portions comprise means for receiving said first electrical contact device;

prevention means for preventing said first electrical contact device from extending into said second portion from said first portion in response to positioning said first electrical contact device and said at least one compartment in a position other than a first position with respect to each other, said prevention means comprising a lug and a ramp abutting said lug, wherein said lug comprises means for engaging an opening in said electrical contact device positioned behind the front of said electrical contact device when said electrical contact device and said at least one compartment are in said first position so as to launch said electrical contact device into engagement with said connector, wherein said ramp comprises means for guiding said electrical contact device over said ramp and over said lug so that said lug engages said opening, wherein said ramp further comprises means for engaging an aperture in the front of said electrical contact device and for guiding said front of said electrical contact device to abut said lug so as to space said opening from said lug, thereby preventing the engagement of said opening and said lug when the electrical contact device and the at least one compartment are positioned in a position other than said first position.

29. The connector defined by claim 28 wherein said prevention means comprises means for permitting said electrical contact device to extend into said second portion in response to positioning said electrical contact device and said at least one compartment in said first position.

30. The connector defined by claim 29 in combination with said electrical connector device.

31. The connector defined by claim 29 wherein said electrical contact device comprises a stop behind the front of said electrical contact device, wherein said prevention means comprises an elastic tongue comprising a lug comprising means for engaging the front of said electrical contact device when said electrical contact device and said at least one compartment are in a position other than said first position, wherein said elastic tongue further comprises a heel having a surface facing said aperture of said connector, wherein said surface comprises two spaced apart ramps, wherein each of said ramps comprise means for engaging one of two spaced apart tabs on said electrical contact device during insertion of said electrical contact device into said first portion so as to permit said tabs to pass over said ramps into said second portion, thereby permitting the positioning of said heel at substantially the same position along the longitudinal axis of said compartment as said stop so that said heel comprises means for engaging said stop when said electrical contact device and said at least one compartment are in said first position with respect to each other.

32. An electrical contact device comprising:

a rear end comprising means for enclosing an electrical conductor;

a front end comprising a channel comprising an upper edge and a substantially U-shaped extension comprising two spaced apart tabs having rounded ends, wherein said tabs extend higher than said upper edge of said channel, wherein said device further comprises a notch positioned between said tabs and said channel, wherein said notch is positioned lower than said upper edge of said channel.

33. An electrical connector comprising:

two complementary shaped box elements, each comprising a body comprising a plurality of compartments, wherein each compartment comprises:

an aperture adapted to receive an electrical contact device;

a locking device having a lug for engaging a complementary device on said electrical contact device to lock said electrical contact device in said compartment;

a portion extending from said aperture, wherein said portion comprises:

a lug comprising a portion sufficiently steep to prevent said electrical contact device from passing over said portion of said lug when said electrical contact device is inserted into said compartment in a position different from a normal insertion position; and a barrier comprising a ramp connected to said steep portion of said lug, wherein in said normal insertion position said electrical contact device passes over said ramp and said lug, wherein in a position different from said normal insertion position said electrical contact device abuts said portion of said lug; said complementary device comprising an opening in a first surface of said electrical contact device, wherein said barrier has a width smaller than an aperture positioned at the free end of a second wall of said electrical contact device positioned above said first wall, and wherein the width of said lug is larger than the width of said aperture of said electrical contact device.

34. The connector defined by claim 33 in combination with said electrical contact device.

35. The connector defined by claim 33 wherein said lug has the shape of an upside down frusto-pyramid.

36. The connector defined by claim 33 wherein said locking device comprises:

an elastic tongue comprising:

a heel comprises means for engaging a stop on said electrical contact device, wherein said heel comprises a surface facing said aperture, wherein said surface comprises a plurality of ramps comprising means for engaging tabs positioned on the free end of said electrical contact device; and said lug, wherein said heel is integral with said lug, wherein said lug disengages said electrical contact device when said electrical contact device is inserted into said compartment in said normal insertion position, wherein said steep portion of said lug prevents said electrical contact device from being inserted into said compartment when said electrical contact device is inserted in a position different from said normal insertion position.

* * * * *

UNITED STATES PATENT AND TRADEMARK OFFICE

CERTIFICATE OF CORRECTION

PATENT NO. : 4,732,437

DATED : March 22, 1988

INVENTOR(S) : Bertrand VANDAME

It is certified that error appears in the above-identified patent and that said Letters Patent is hereby corrected as shown below:

At column 2, line 1 of the printed patent, change "interfers" to ---interfere---.

At column 2, line 61 of the printed patent, change "devices" to ---device is---.

At column 3, line 5 of the printed patent, insert ---is--- after "device".

At column 4, line 17 of the printed patent, change "incline" to ---inclined---.

At column 4, line 38 of the printed patent, insert ---the --- after "relates to".

At column 4, line 51 of the printed patent, insert ---the--- before "first".

At column 4, line 55 of the printed patent, insert ---be --- before "positioned".

At column 5, line 29 of the printed patent, change "electical" to ---electrical---.

At column 5, line 39 of the printed patent, change "heal" to ---heel---.

At column 6, line 8 of the printed patent, change "devices" to ---device---.

At column 6, line 47 of the printed patent, change "be understood" to ---be better understood because---.

At column 6, line 56 of the printed patent, delete "." after "invention".

At column 7, line 13 of the printed patent, change "illustrates" to ---illustrate---.

UNITED STATES PATENT AND TRADEMARK OFFICE

CERTIFICATE OF CORRECTION

PATENT NO. : 4,732,437

DATED : March 22, 1988

INVENTOR(S) : Bertrand VANDAME

It is certified that error appears in the above-identified patent and that said Letters Patent is hereby corrected as shown below:

At column 7, line 57 of the printed patent, change "then" to ---than---.

At column 8, line 4 of the printed patent, change "preferable" to ---preferably---.

At column 8, line 14 of the printed patent, change "looking" to ---locking---.

At column 8, line 30 of the printed patent, change "complimentary" to ---complementary---.

At column 8, lines 36 and 37 of the printed patent, change "complimentary" to ---complementary---.

At column 8, line 45 of the printed patent, change "out" to ---cut---.

At column 11, line 9 of the printed patent, delete second "to"; insert ---a--- after "in response to".

At column 13, line 21 of the printed patent, change "haviang" to ---having---.

At column 13, line 24 of the printed patent, change "ramp" to ---ramps---.

At column 15, line 15 of the printed patent, change "comprises" to ---comprising---.

Signed and Sealed this

Fourth Day of October, 1988

*Attest:*

DONALD J. QUIGG

*Attesting Officer*

*Commissioner of Patents and Trademarks*